United States Patent [19]

McIntyre

[11] Patent Number: 4,503,578

[45] Date of Patent: Mar. 12, 1985

[54] BRUSH ASSEMBLY APPARATUS FOR CLEANING CANNONS

[75] Inventor: Donald J. McIntyre, Dallas, Tex.

[73] Assignee: San/Bar Corporation, Trvine, Calif.

[21] Appl. No.: 392,567

[22] Filed: Jun. 28, 1982

[51] Int. Cl.[3] ..... B08B 9/02

[52] U.S. Cl. ..... 15/104.165; 15/104.2; 15/247

[58] Field of Search ..... 15/104.16, 104.16 S, 15/104.19, 104.2, 104.3 R, 104.02, 104.03, 104.05, 247

[56] References Cited

U.S. PATENT DOCUMENTS

| | | | |
|---|---|---|---|
| 93,723 | 8/1869 | Kunkel | 15/104.2 |
| 232,118 | 9/1880 | Felthouse | 15/104.19 X |
| 849,786 | 4/1907 | Hildenbrand | 15/104.19 |
| 877,778 | 1/1908 | Kauffman | 15/104.165 X |
| 1,195,308 | 8/1916 | Whidden | 15/104.2 |
| 1,745,575 | 2/1930 | Hooker | 15/104.165 |
| 1,766,192 | 6/1930 | Schlegel | 15/104.16 |
| 1,771,428 | 7/1930 | Wilson | 15/104.2 |
| 1,809,725 | 6/1931 | Roe | 15/104.2 UX |
| 2,221,853 | 11/1940 | Wilson | 15/104.2 X |
| 2,642,602 | 6/1953 | Kelly | 15/104.19 X |
| 2,805,434 | 9/1957 | Hopkins | 15/104.16 |
| 3,466,691 | 9/1969 | Wessel | 15/104.19 |
| 3,768,109 | 10/1973 | Wardell | 15/104.2 X |

FOREIGN PATENT DOCUMENTS

| | | | |
|---|---|---|---|
| 2817886 | 10/1979 | Fed. Rep. of Germany | 15/104.2 |
| 121030 | 12/1918 | United Kingdom | 15/104.2 |

*Primary Examiner*—Philip R. Coe
*Assistant Examiner*—Frankie L. Stinson
*Attorney, Agent, or Firm*—Jackson, Jones & Price

[57] ABSTRACT

A brush assembly for cleaning the bore of a cannon. The assembly includes a cylindrically-shaped brush (46) supported on front and rear plates (22, 24). An assembly shaft (30) extends through the plate, the center of the brush and through the rear plate. A threaded collar (36) is connected to the rear of the assembly shaft for receiving a ramming shaft (42). A conically-shaped centering element (58) is disposed over the threaded collar and is provided with an opening for accommodating the ramming shaft. The centering element realigns the brush with the bore thereby permitting the brush assembly to be pulled back through the barrel (72) without the necessity of manually recentering the assembly with the bore.

2 Claims, 9 Drawing Figures

BRUSH ASSEMBLY APPARATUS FOR CLEANING CANNONS

BACKGROUND OF THE INVENTION

1. Field of the Invention

The subject invention relates generally to the field of cleaning apparatus for weapons and more particularly to a brush assembly for cleaning the bore of a cannon.

2. Background Art

It is necessary to periodically clean the bore of an artillery piece once several rounds have been fired in order to remove deposited debris and corrosive chemicals. A lubricant/protectant should preferably be applied after cleaning. Presently such cleaning requires the strenuous labor of several persons. Moreover, the cleaning apparatus now in use presents serious safety hazards to the cleaning crew.

Cleaning is now accomplished using a cylindrically-shapped metal-bristle brush. The diameter of the prior art brush is slightly larger than the bore of the piece to be cleaned. The metal bristles are typically made of phosphor-bronze. Horse hair bristles are also used, in addition to the metal bristles, for the purpose of absorbing the cleaning solvent.

The metal brush is provided with a threaded collar for receiving a ramming shaft. The shaft is a few feet longer than the barrel of the piece to be cleaned. Cleaning is accomplished by applying a solvent to the brush and inserting the brush into either the muzzle or breach of the barrel. The brush is then pushed through the bore. For smaller pieces, such as a 105 mm howitzer, three persons are required to push or "punch" the stiff brush through the barrel. For larger guns, additional persons are required. For example, up to ten persons may be required for punching a 203 mm gun.

Once the brush has exited the opposite end of the barrel, the brush is pulled back through. It is necessary, however, for an additional person located at the opposite end to manually realign the brush with the bore. Once the brush is realigned, the crew members gripping the ramming shaft are signaled and the brush is drawn back through the barrel by pulling on the ramming shaft.

The above process is repeated four to eight times in order to insure that the barrel is throughly cleaned. Next, the solvent is removed by placing a cloth rag over the brush and passing the brush through the barrel one or more additional times. Finally, the bore is coated with a lubricant/persevative by applying the lubricant-/perservative to a cloth rag, placing the rag over the brush and passing the brush through the barrel one or more additional times.

The above-described cleaning process posesses several shortcomings. By way of example, several persons are required to push the stiff metal-bristled brush through the bore. In addition, once the brush has been introduced into the bore, it is impossible to reverse the direction of the brush so as to achieve a scrubbing motion. This is because the metal brush bristles take a set once the brush is moved within the bore in a given direction.

Another disadvantage of the prior art cleaning apparatus arises out of the fact that an additional person is required to be positioned at the end of the barrel opposite the ramming crew. The additional crew member recenters the brush and repositions the cleaning rag which usually falls off the brush when the brush exits the barrel. This is highly disadvantages in that not only is the size of the cleaning crew increased, but the additional crew member is vulnerable to injury.

Recentering is accomplished by gripping the metal brush and manually positioning the brush in the center of the bore. There is a distinct possibility that the crew member will be injured by the sharp metal bristles of the brush. In addition, once the brush is recentered, the ramming crew is signaled and the brush is pulled back through the barrel with great force. If the brush is prematurely pulled, serious injuiry will result if the crew member recentering the brush has not yet removed his/her fingers. If a tank gun is being cleaned, the additional crew member is positioned inside the turret which further increases the likelihood that the brush will be pulled at an inopportune moment. In addition, for larger pieces such as a 203 mm gun, the muzzle of the barrel is typically approximately fourteen feet above the ground. The additional crew member is usually required to crawl up the barrel to the muzzle in order to recenter the brush. This presents an obvious safety hazard.

There have been various attempts to overcome the above-described shortcomings. One attempt involves the use of a nylon bristle brush in lieu of one having metal bristles. This enables the ramming crew to be reduced in size inasmuch as less force is required to push/pull the brush through the barrel. In addition, the more flexible nylon bristles permit a back and forth scrubbing action to be used so that the barrel is more completely cleaned.

Although brushes utilizing nylon bristles have overcome a few of the disadvantages of the prior art, an additional crew member is still required. The present invention overcomes all of the above-described disadvantages of the prior art, including the elimination of the additional crew member. Moreover, the prior art brush assemblies can be quickly and inexpensively retrofitted to incorporate the subject invention. These and other advantages of the subject invention will become apparent upon reading the following Detailed Description of the Invention in conjunction with the drawings.

SUMMARY OF THE INVENTION

A brush assembly for cleaning the bore of a cannon is disclosed. The assembly includes a brush which preferably has nylon bristles. The brush is provided with apparatus, such as a threaded collar, for receiving a ramming shaft. A centering element is affixed to the brush for centering the brush with respect to the bore of the cannon to be cleaned. The centering element permits the brush assembly to be pushed completely through the bore of the cannon and then pulled back through the bore without the necessity of manually realigning or recentering the brush.

DETAILED DESCRIPTION OF THE INVENTION

Figure 1:
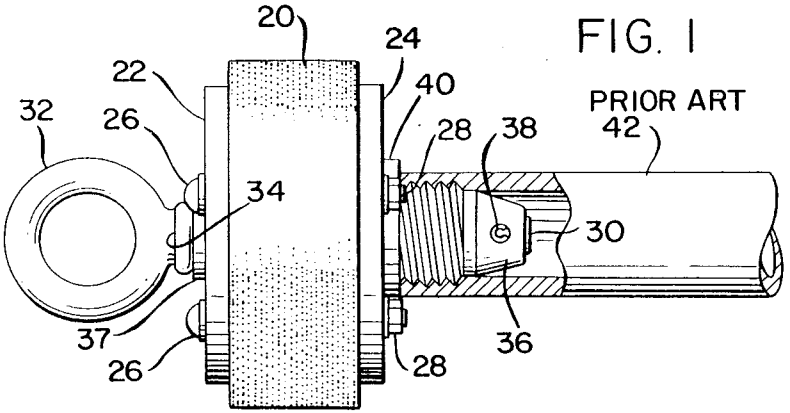
FIG. 1 is an elevational view of a prior art brush assembly.

Referring now to the drawings, an exemplary embodiment of a prior art cleaning brush assembly may be seen in FIG. 1. The assembly includes a brush 20 having metal bristles. Brush 20 is fabricated from a conventional steel channel brush strip having phosphor-bronze bristles crimped therein. The metal channel is wound in the form of a spiral with the bristle directed outwardly to form the desired cylindrical shape.

The spiral brush 20 is compressed between forward and rear circular plates 22 and 24, respectfully. The dimensions of plates 22 and 24 and brush 20 are selected in accordance with the caliber of the gun to be cleaned. The diameter of the compressed spiral brush is slightly larger than the bore of the gun to be cleaned. The diameter of plates 22 and 24 is smaller than the bore so that the brush bristles are exposed for cleaning.

Plates 22 and 24 and brush 20 are secured together by way of three threaded bolts 26 extending through openings provided in the forward plate 22, through the center of the brush 20 and through openings provided in the rear plate 24. Three nuts 28 and associated locking washers are used to hold the sandwiched assembly together.

The prior art brush assembly further includes an assembly shaft 30. The front end of shaft 30 is formed into an eyelet or pull ring 32. A raised annular member 34 is formed on shaft 30 adjacent the pull ring. A washer 36 is disposed between the annular member 34 and forward plate 22. The assembly shaft passes through a central opening in forward plate 22, through brush 20 and through another central opening formed in rear plate 24.

The rear portion of shaft 30 extends past rear plate 24 and receives a threaded collar 36. Collar 36 is provided with a roll pin opening as is the end of shaft 30. The collar is secured to the shaft by aligning the two openings and inserting therein a roll pin 38. A washer 40 is disposed between collar 36 and rear plate 24.

Collar 36 serves to secure the assembly shaft 30 with the remainder of the brush assembly. In addition, collar 36 is provided with threads for receiving a ramming shaft 42. Shaft 42, which is several feet longer than the barrel of the piece to be cleaned, is hollow and is provided with threads on the inner diameter of one end thereof which correspond to the threads of collar 36. The ramming shaft 42 and brush assembly are secured together by screwing the threaded end of the shaft 42 over collar 36.

Figure 2:
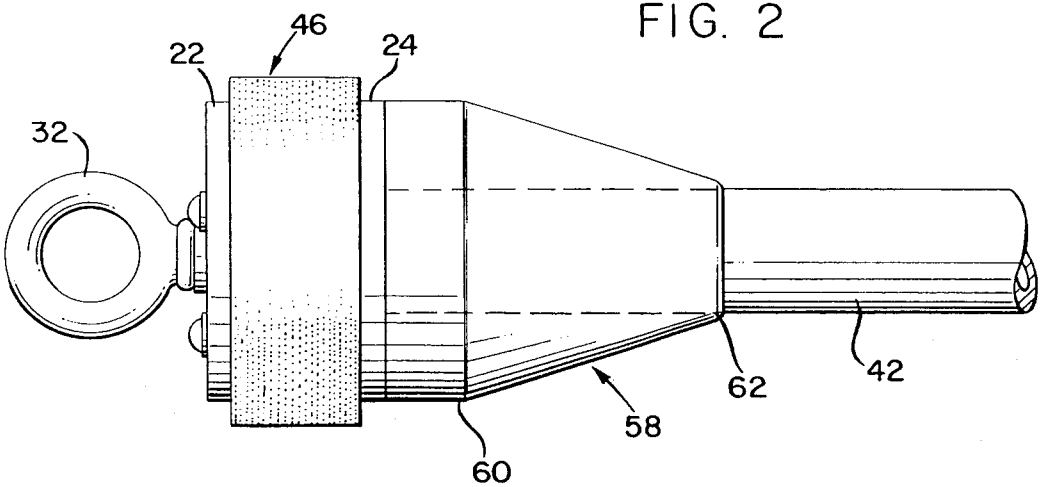
FIG. 2 is an elevational view of the subject invention.
Figure 4:
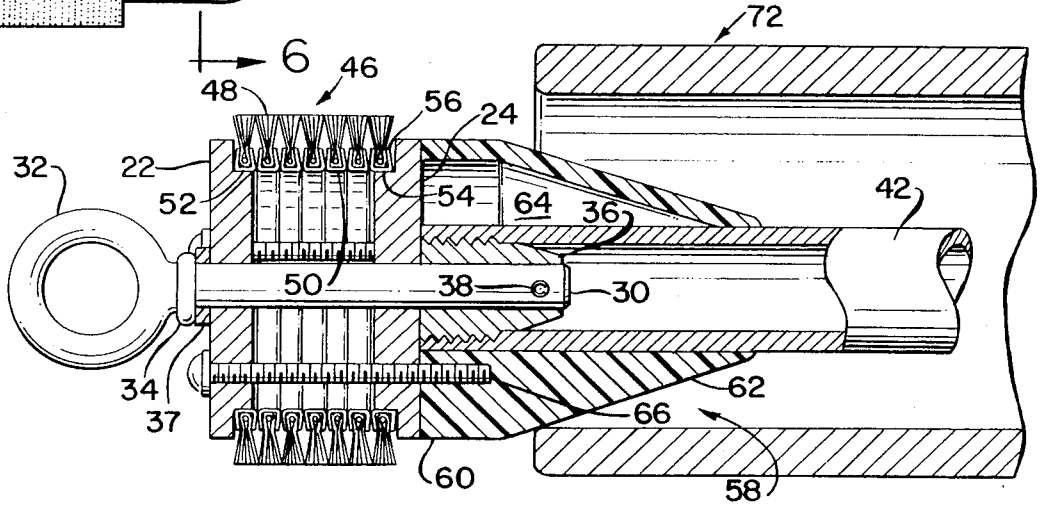
FIG. 4 is a cross-sectional view of the subject invention as it is being pulled back in to the bore of the barrel.

Referring now to FIGS. 2 and 4, a preferred embodiment of the subject invention may be seen. It is important to note that many elements of the improved brush assembly are identical to those of the prior art assembly shown in FIG. 1. This feature facilitates the conversion of prior art brush assemblies to the improved brush assembly.

The common elements, which are identified by identical numerals, include assembly shaft 30, front and rear plates 22 and 24, and threaded collar 36. The new elements include a brush, generally indicated by the numeral 46. As can best be seen in FIG. 4, brush 46 is provided with nylon bristles 48. The bristles 48 are installed within a conventional steel channel brush strip 54 by first folding the bristles in half over a metal wire 50. The folded bristles are then inserted within the channel strip and the strip is crimped thereby securing the bristles in place. The elongated brush element is then wound into a spiral as shown. The spiral brush 46 is sandwiched between rear and forward plates 22 and 24 in the same manner as the prior art assembly. Plates 22 and 24 are provided with flanges 52 and 54 respectively, for receiving the extreme ends of brush 46. The relatively rigid metal channel strip 50 provides support for the central portion of the brush.

Brush 46 has approximately the same dimensions as the prior art metal bristle brushes. The length of brush 46 is typically approximately 1.5 to 1.625 inches with the diameter, including bristles, being slightly greater than that of the bore of the piece to be cleaned. The nylon bristles are typically 0.010 to 0.008 inches in diameter and may be crimped in the conventional manner. It has been found that the bristles should preferably extend past the metal channel strip approximately 0.250 to 0.375 inches. A soft bristle sold by FMC, Inc. of Pomona, Calif. and having part number "6—6" has been found to be suitable for this application. This bristle has the ability to adsorb an optimum quanity of solvent.

The subject brush assembly further includes a novel centering member, generally designated by the numberal 58. Member 58 is preferably fabricated from high density polyethylene or polypropylene plastic. Other materials can be used provided they are resistant to relatively high temperatures and to the chemicals typically encountered in the cleaning of artillery pieces including acids and solvents. The material should also be relatively rigid yet soft enough to avoid damage to the barrel. In addition, it is preferable that the material have a memory, i.e., that it return to its original shape if deformed by an impact of the like. Member 58 is prefereably manufactured using injection molding techniques although machining and other methods of manufacture may be used.

As can best be seen in FIG. 4, centering member 58, which has a circular cross-section, is positioned over threaded collar 36 adjacent rear plate 24. Member 58 includes a large-diameter portion 60 adjacent plate 24 and having the same diameter. Portion 60 tapers down to a relatively small diameter portion 62. Portion 62 has a diameter approximately the same as ramming shaft 42. Member 58 is approximately 4 inches in length if a 105 mm gun is to be cleaned. The length should be increased for larger guns.

Figure 5:
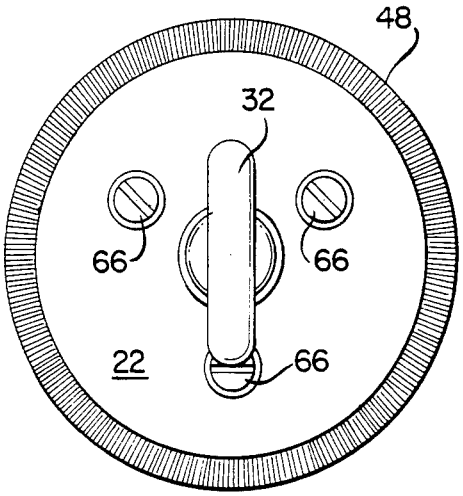
FIG. 5 is an elevational front view of the subject invention.
Figure 6:
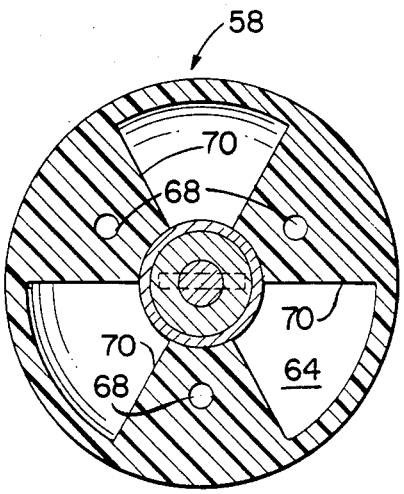
FIG. 6 is a cross-sectional view taken through section line 6—6 of FIG. 3 showing the interior of the centering member.

Cone-shaped centering member 58 has an interior cavity 64 for accomodating collar 36 and a ramming shaft 42. Member 58 is secured to the rear plate 24 by way of three screws 66 which are somewhat longer than the corresponding screws 26 of the prior art device of FIG. 1. Screws 66 extend through openings provided in forward plate 22 (FIGS. 4 and 5) through the interior of brush 46, through openings provided in rear plate 24 and into centering member 58. As can be seen in FIG. 6, centering member 58 is provided with three openings 68 which coincide with the three openings formed in the rear plate 24. Openings 68 are tapped to receive the threads of screws 60. As an alternative to tapping, each opening 68 can be provided with a relatively deep countersink (not shown) which extends from the tapered portion of member 58 to the opening. Screws 66 can then each be secured by a washer and nut positioned within the countersink.

Cavity 64 can be in the form of an axial bore, having a diameter slightly larger than ramming shaft 42, which extends through the entire length of the member. In order to reduce costs and weight, it is preferable to remove or delete additional material from cavity 64 so as to form lands 70 around each of the screw hole 68 as can be seen in FIGS. 4 and 6.

Conversion of the prior art brush assembly of FIG. 1 to the present improved assembly is straight forward and can be accomplished with few tools in a short period of time. First, ramming shaft 42 is unscrewed from threaded collar 36 of the prior art device. Next, a punch is used to remove roll pin 38. With roll pin 38 removed, the collar is separated from the assembly shaft 30.

Shaft 30 is then slid out of the brush assembly with washers 37 and 40 being retained. Next, the three nuts 28 are removed and discarded as are the corresponding three screws 26. The front and rear plates 22 and 24 are then separated thereby releasing the wire brush 20 which is discarded.

The new nylon bristle brush 46 is then positioned between the front and rear plates 22 and 24 on flanges 52 and 54. Next, the assembly shaft 30 is reinserted through the openings in the front and rear plates with washer 37 is place. The threaded collar is then positioned over the end of shaft 30 and locked in place with roll pin 38. The centering member 58 is then placed adjacent rear plate 24 and the three screws 66 are threaded into the openings 68 located in the member. Finally, the ramming shaft 42 is inserted into the center member opening and screwed onto collar 36.

In operation, a cleaning solvent is applied to nylon brush 46. A multi-purpose cleaner marketed by the Break-Free division of the San Bar Corporation of Irvine, California under the trademark "BREAK-FREE CLP" has been found to be particularly suitable for this application. The brush assembly is then rammed through the bore of the barrel. This can be accomplished by only one person for small to medium caliber weapons. The assembly can be moved back and forth so as to thoroughly scrub the barrel. A rope can be attached to pull ring 32 if desired thereby permitting the assembly to be pulled through the barrel.

Figure 3:
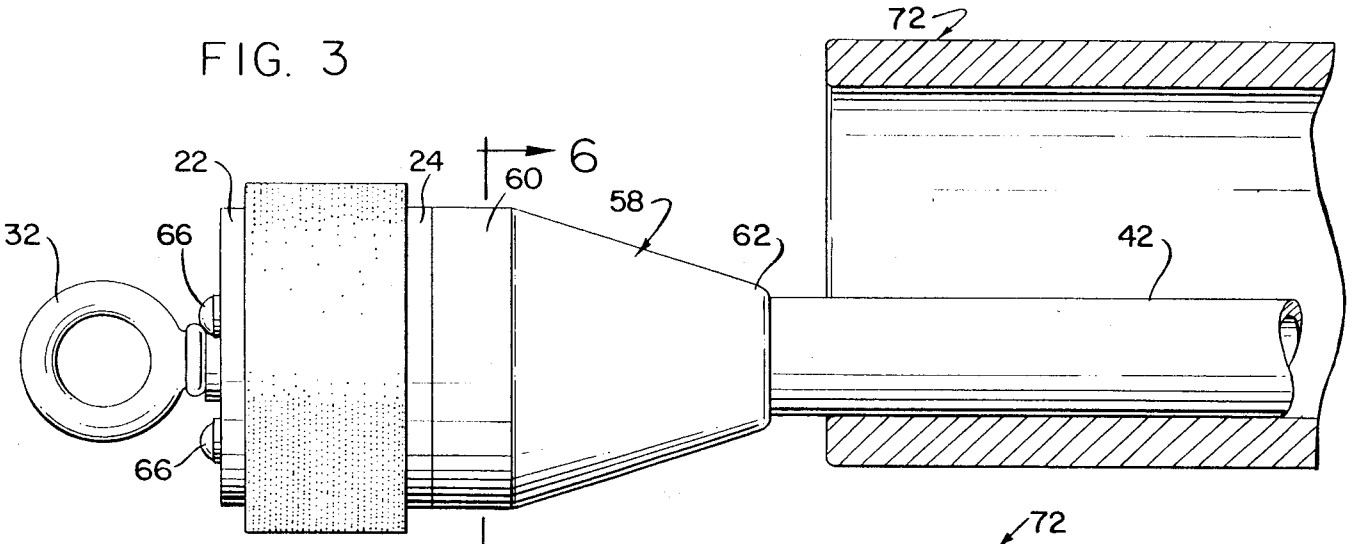
FIG. 3 is an elevational view of the subject invention just after it has been pushed entirely through a barrel.

When the brush assembly is pushed entirely through the bore, the ramming shaft 42 will lay adjacent the barrel, which is generally designated by the numeral 72, as shown in FIG. 3. However, unlike the prior art assembly, the subject brush assembly can be pulled back through the barrel by simply pulling on the ramming shaft 42. As the shaft is pulled, the inclined surface of centering member 58 will contact the edge of the barrel 72 as shown in FIG. 4. The centering member 58 will climb up the barrel until the barrel contacts the flat portion 60 of the member. At that time the brush assembly will be properly aligned with the bore so that the assembly can be easily pulled back through by the ramming crew.

Figure 8:
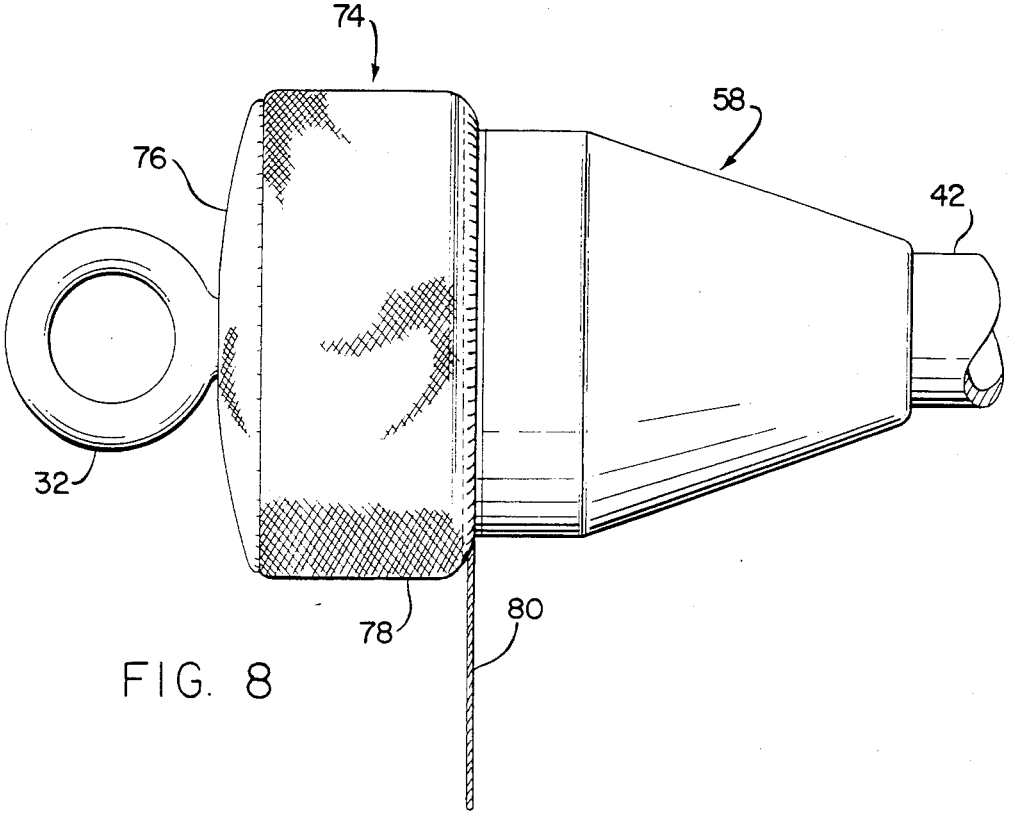
FIG. 8 is an elevational view of the subject invention fitted with a cleaning sleeve.
Figure 9:
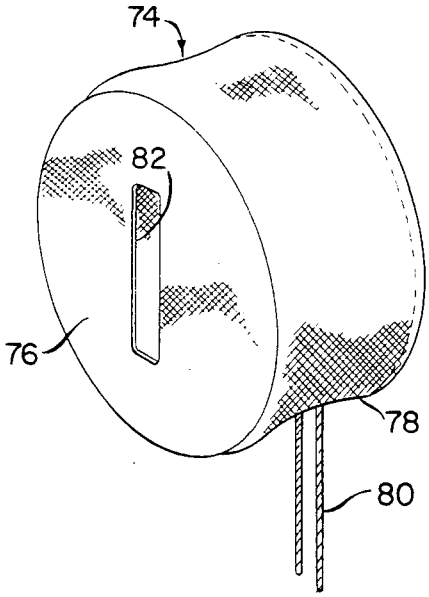
FIG. 9 is a perspective view of the cleaning sleeve.

Although a cloth rag can be used with the subject device for mopping purposes and for applyling lubricants and preservatives, it is preferable to use the novel sleeve shown in FIGS. 8 and 9. The sleeve, generally designated by the numeral 74, is preferably manufactured from a three-way knit polyester fabric. Such polyester material is high in strength, will stretch to some extent and is relatively resistent to abrasion In addition, the fabric has somewhat abrasive texture that will facilitate cleaning.

Sleeve 74 is comprised of a circular panel section 76 which is sewn to a cylindrically-shaped panel 78. Panel section 76 has a diameter and panel section 78 has a length which are slightly larger than the diameter and length, respectively, of brush 48. Panel section 76 is provided with a elongated opening or slit 82 through which pull ring 32 passes. The periphery of panel 78 is provided with a seam for receiving a draw string 80.

As can be seen in FIG. 8, sleeve 74 is substituted for a conventional cloth rag when the bore is to be mopped or when lubricants or protectants are to be applied. The previously noted multi-purpose cleaner "BREAK-FREE CLP" is perferable for use as a lubricant and protectant. The sleeve is positioned over the brush as can be seen in FIG. 8 with the pull ring 32 extending through slit 82. The sleeve 74 is then secured in place by tightening draw string 89 and tying the two ends of the string together. With the sleeve so secured, it will not fall off the brush as do the prior art cleaning rags. When the cleaning is completed sleeve 74 can be removed and cleaned using only cold tap water. The sleeve can then be reused several times and then discarded when worn out.

Figure 7:
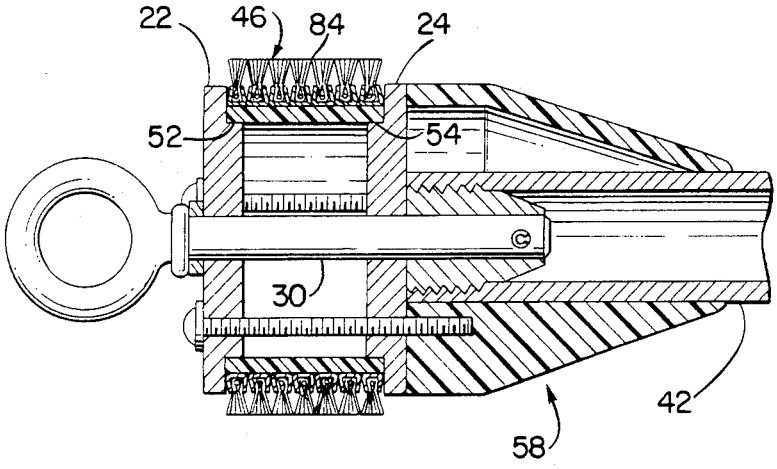
FIG. 7 is a cross-sectional view of the subject invention with a brush shim installed.

After several cleanings, nylon bristles 48 of brush 46 will wear down. The life of the brush can be extended using the apparatus depicted in FIG. 7. The worn brush assembly is first dissasembled. Next, a cylindrically-shaped shim 84 having a wall thickness of approximately 0.0625 is placed inside cylindrically-shaped brush 46. The outside diameter of shim 84 is larger than the diameter of flanges 52 and 54 of plates 22 and 24 by twice the wall thickness. Accordingly, it will be necessary to slightly twist spiral brush 46 in a direction opposite that of the windings so as to momentarily increase the inside diameter of the brush. At that time, shim 84 is slipped inside the brush and the brush is released. The brush assembly is then assembled as before with shim 84 being secured on flanges 52 and 54. The diameter of brush 46 is expanded by twice the thickness of the shim thereby exposing an additional length of bristle.

If desired, a second centering cone can be provided to facilitate the introduction of the brush assembly into the bore on the ramming end of the barrel. The second cone member (not shown) is positioned adjacent forward plate 22 and is tapered from a diameter approximately equal to that of forward plate 22 down to a diameter slightly larger than that of the pull ring 32. The cone member is provided with an axial bore extending through its entire length to accomodate the pull ring and to provide access to same. The cone member is secured by three screws which replace screws 66. The screws are inserted into countersink openings provided in the forward cone member through the remainder of the assembly and into the tapped openings in rear centering member 58. If a second centering cone is used, the sleeve of FIGS. 8 and 9 would have to be modified by deleting panel 76 and adding a second draw string around the front periphery of panel 78.

Also, it would be possible to replace the cylindrically-shaped brush with other types of cleaning elements such as abrasive cloth. In any event, the cleaning element should not have any metal-removing properties which would cause damage to the bore. If abrasive cloth or the like is used, the cleaning element would be provided with a cylindrically-shaped backing to provide support.

Thus, an improved brush assembly for cleaning the bore of an artillery piece is disclosed. While a preferred embodiment of the invention has been disclosed, it is to be understood that various changes could be made without varying from the spirit and the scope of the invention as defined by the subject claims.

What is claimed is:

1. A brush assembly for cleaning the bore of a cannon comprising:

a cylindrically-shaped brush comprised of an elongated brush element of nylon bristles held in a steel channel strip, said strip wound in the form of a spiral;

a forward plate having a flange thereon facing towards a rear plate for supporting said brush;

a rear plate having a flange thereon facing toward the forward plate for supporting said brush;

a plurality of screws extending through said forward and rear plates for squeezing the spirally wound brush element together between said forward and rear plates;

a center shaft coupled to said forward and rear plates, said shaft being positioned coaxial with respect to said brush and extending beyond the rear plate;

a threaded collar coupled to said center shaft, said collar being disposed over the center shaft extending beyond said rear plate adjacent said rear plate and fastened to said center shaft;

a running shaft threadably secured over said collar and adjacent said rear plate;

a centering element of high density plastic disposed over said collar and said running shaft adjacent said rear plate, said centering element having an opening for receiving a running shaft and an inclined surface generally extending from the outer periphery of said rear plate to said opening, said centering element being held fast to said rear plate by said plurality of screw;

an eyelet positioned adjacent said foward plate as an integral part of said center shaft; and a cylindrically-shaped shim disposed between said forward and rear plates and said brush supported by said forward and rear plate flanges for lengthening the bristle extensions of the brush further beyond the forward and rear plate diameter.

2. The brush assembly of claim 1 further comprising a fabric bag disposed over said brush, said bag being provided with an opening for receiving said eyelet and a drawstring for securing said bag over said brush.

* * * * *